US008129082B2

(12) United States Patent
Sarayama et al.

(10) Patent No.: US 8,129,082 B2
(45) Date of Patent: Mar. 6, 2012

(54) ELECTROPHOTOGRAPHIC PHOTORECEPTOR, IMAGE FORMING METHOD USING ELECTROPHOTOGRAPHIC PHOTORECEPTOR, IMAGE FORMING APPARATUS, AND PROCESS CARTRIDGE FOR IMAGE FORMING APPARATUS

(75) Inventors: Seiji Sarayama, Miyagi (JP); Tetsuya Toshine, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 991 days.

(21) Appl. No.: 12/024,778

(22) Filed: Feb. 1, 2008

(65) Prior Publication Data

US 2008/0220346 A1 Sep. 11, 2008

(30) Foreign Application Priority Data

Mar. 6, 2007 (JP) ..... 2007-055878

(51) Int. Cl.
*G03G 5/14* (2006.01)

(52) U.S. Cl. ..... 430/60; 430/57.2; 430/123.4; 399/159

(58) Field of Classification Search ..... 430/57.2, 430/60, 63, 65, 123.4; 399/159
See application file for complete search history.

(56) References Cited

U.S. PATENT DOCUMENTS

| | | | | |
|---|---|---|---|---|
| 5,737,671 | A * | 4/1998 | Watanabe | 399/159 |
| 5,932,385 | A * | 8/1999 | Takamura et al. | 430/63 |
| 6,780,239 | B2 | 8/2004 | Sarayama et al. | |
| 6,949,140 | B2 | 9/2005 | Sarayama et al. | |
| 7,220,311 | B2 | 5/2007 | Iwata et al. | |
| 7,261,775 | B2 | 8/2007 | Iwata et al. | |
| 2007/0034143 | A1 | 2/2007 | Sarayama et al. | |
| 2007/0084399 | A1 | 4/2007 | Sarayama et al. | |
| 2007/0128746 | A1 | 6/2007 | Iwata et al. | |
| 2007/0215034 | A1 | 9/2007 | Iwata et al. | |

FOREIGN PATENT DOCUMENTS

| | | |
|---|---|---|
| JP | 2003-313098 | 11/2003 |
| JP | 3631724 | 12/2004 |
| JP | 2006-11485 | 1/2006 |
| JP | 2006-113553 | 4/2006 |
| JP | 3788037 | 4/2006 |
| WO | WO 2007117034 A1 * | 10/2007 |

* cited by examiner

*Primary Examiner* — Christopher Rodee
(74) *Attorney, Agent, or Firm* — Cooper & Dunham LLP

(57) ABSTRACT

A photoreceptor includes a conductive support body, an intermediate layer, and a photosensitive layer. The intermediate layer is made of gallium nitride (GaN) crystals having electron affinity greater than that of the photosensitive layer and formed between and in contact with the conductive support body and the photosensitive layer. The photosensitive layer is composed of either a single layer type photosensitive layer or a laminated type photosensitive layer.

17 Claims, 9 Drawing Sheets

ELECTROPHOTOGRAPHIC PHOTORECEPTOR, IMAGE FORMING METHOD USING ELECTROPHOTOGRAPHIC PHOTORECEPTOR, IMAGE FORMING APPARATUS, AND PROCESS CARTRIDGE FOR IMAGE FORMING APPARATUS

BACKGROUND

1. Technical Field

This disclosure relates to an electrophotographic photoreceptor, an image forming method using the electrophotographic photoreceptor, an image forming apparatus, and a process cartridge for the image forming apparatus and, in particular, to a photoreceptor including compound semiconductors.

2. Description of the Related Art

In recent years and continuing to the present, the electrophotographic technology has been widely used not only in the field of copiers, but also in the field of various printers and facsimile machines because it can provide images excellent in instantaneousness, quality, and shelf life. An electrophotographic process in the electrophotographic technology basically consists of an image forming process and an initialization process for repetitive use of a photoreceptor, namely, a destaticizing process. In other words, the image forming process includes the steps of uniformly charging the surface of the photoreceptor, forming an electrostatic latent image by image exposure corresponding to an original, developing the electrostatic latent image with toner, and transferring and fixing the toner image to a sheet (the toner image may pass through a transfer body on its way to the sheet in some cases). Furthermore, the destaticizing process includes the steps of cleaning the developer left on the surface of the photoreceptor and removing the residual charges.

Until recently, known photoreceptors playing a central role in the electrophotographic technology have been made of inorganic photoconductive materials such as selenium, arsenic-selenium alloy, cadmium sulfide, and zinc oxide. However, there have been recently developed photoreceptors made of organic photoconductive materials having advantages such as easiness in film deposition and manufacturing without causing environmental pollution. Particularly, so-called laminated type photoreceptors including a charge generation layer and a charge transfer layer are in the mainstream and thus manufactured in quantities because they can provide high sensitivity, a high level of safety due to their wide selection range of materials, and relatively high advantages in terms of costs attributable to increased coating productivity.

Meanwhile, in order to prevent the injection of charges (holes) from a conductive support body to a photosensitive layer, there have been proposed photoreceptors that have an undercoating layer (intermediate layer) whose bottom end of the conductive band ranges from a vacuum level to −3.8 eV or lower and which is made of a semiconductive substance between the conductive support body and the photosensitive layer (Patent Document 1). Examples of the semiconductive substance include titanium oxide, strontium titanate, calcium titanate, tungsten oxide, ferric oxide, bismuth oxide, molybdenum sulfide, and the like.

Patent Document 1: JP-A-2006-11485

In conventional electrophotographic systems, it may be difficult to sufficiently suppress the injection of charges (holes) from the conductive support body to the photosensitive layer with the conventional photoreceptors.

BRIEF SUMMARY

In an aspect of this disclosure, there is provided a process cartridge having a photoreceptor capable of sufficiently suppressing the injection of charges (holes) from the conductive support body to the photosensitive layer.

In another aspect of this disclosure, there is provided an image forming apparatus having a photoreceptor capable of sufficiently suppressing the injection of charges (holes) from the conductive support body to the photosensitive layer.

According to another aspect, the photoreceptor includes a conductive support body, a photosensitive layer, and an intermediate layer. The photosensitive layer is formed on the conductive support body. The intermediate layer is formed between and in contact with the conductive support body and the photosensitive layer and is made of gallium nitride crystals having electron affinity greater than that of the photosensitive layer.

Preferably, the intermediate layer is made of plural crystal grains each composed of gallium nitride crystals. Each of the plural crystal grains is in contact with the conductive support body and the photosensitive layer.

Preferably, each of the plural crystal grains has a grain diameter of 1 μm or larger.

Preferably, the gallium nitride crystals are free from dislocation.

In another aspect of this disclosure, an image forming method is performed by the use of the photoreceptor described above. The photoreceptor includes the conductive support body, the photosensitive layer, and the intermediate layer. The photosensitive layer is formed on the conductive support body. The intermediate layer is formed between and in contact with the conductive support body and the photosensitive layer and is made of gallium nitride crystals having electron affinity greater than that of the photosensitive layer. According to various embodiments, the image forming method repeatedly performs, by the use of the electrophotographic photoreceptor described above, at least one of a charging step of charging at least an electrophotographic photoreceptor; a latent image forming step of forming an electrostatic latent image on a surface of the electrophotographic photoreceptor charged in the charging step; a development step of attaching toner to the electrostatic latent image formed in the latent image forming step; a transfer step of transferring the toner image formed in the development step onto a transfer body; and a cleaning step of removing the toner left on the surface of the electrophotographic photoreceptor after the transfer.

In still another aspect, an image forming apparatus having the aforementioned electrophotographic photoreceptor comprises at least one of a charging unit that charges the electrophotographic photoreceptor; a latent image forming unit that forms an electrostatic latent image on a surface of the electrophotographic photoreceptor charged by the charging unit; a development unit that attaches toner to the electrostatic latent image formed by the latent image forming unit; a transfer unit that transfers the toner image formed by the development unit onto a transfer body; and a cleaning unit that removes the toner left on the surface of the electrophotographic photoreceptor after the transfer.

In yet another aspect, a process cartridge for an image forming apparatus having the aforementioned electrophotographic photoreceptor comprises at least one of a charging unit that charges the electrophotographic photoreceptor; a latent image forming unit that forms an electrostatic latent image on a surface of the electrophotographic photoreceptor charged by the charging unit; a development unit that attaches toner to the electrostatic latent image formed by the latent image forming unit; a transfer unit that transfers the toner image formed by the development unit onto a transfer body; and a cleaning unit that removes the toner left on the surface of the electrophotographic photoreceptor after the transfer. The process cartridge is capable of being detached from an image forming apparatus main body.

According to various embodiments of this disclosure, gallium nitride crystals are used in the intermediate layer to manufacture the photoreceptor. Therefore, the intermediate layer has electron affinity greater than that of the photosensitive layer. As a result, the intermediate layer serves as a barrier layer with respect to holes in the conductive support body and smoothly transfers the electrons generated in the photosensitive layer to the conductive support body.

Accordingly, it is possible to suppress the injection of holes from the conductive support body to the photosensitive layer.

DETAILED DESCRIPTION OF THE PREFERRED EMBODIMENTS

Figure 1:
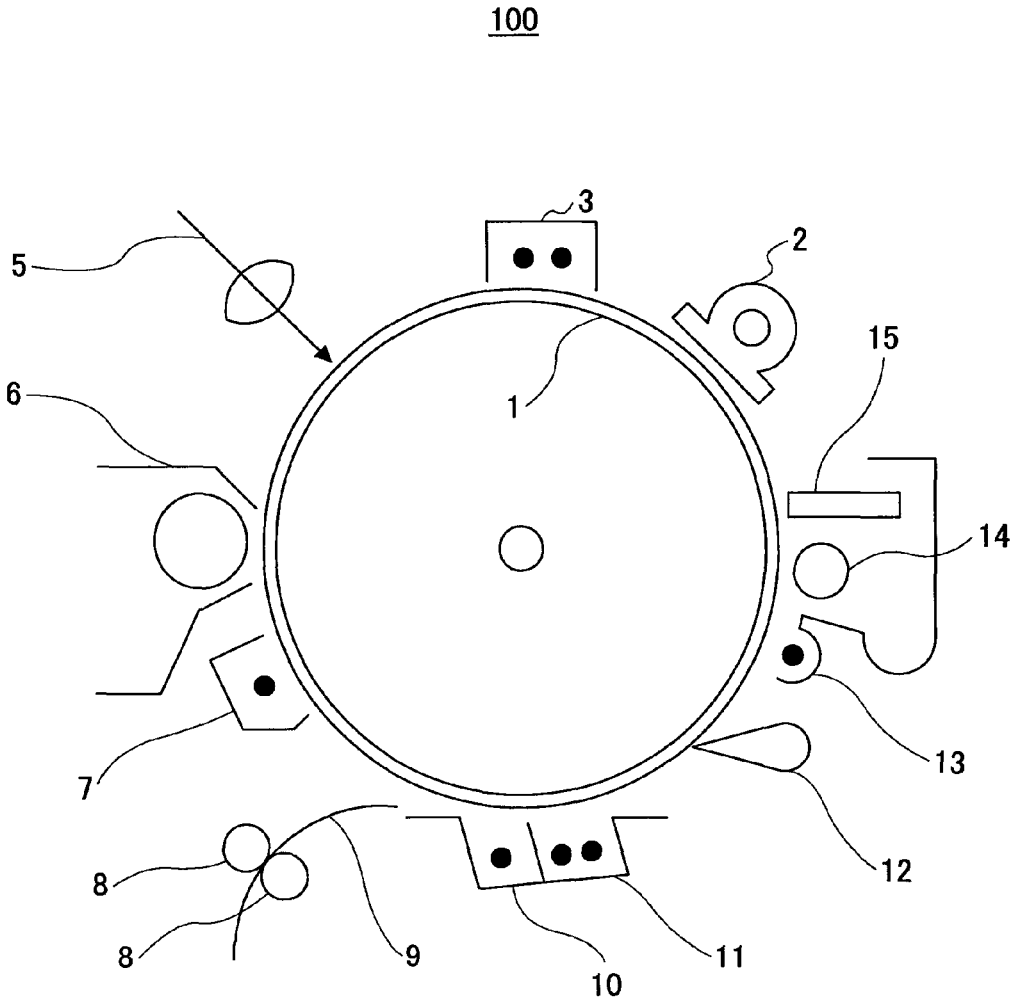
FIG. 1 is a schematic diagram showing a configuration of an image forming apparatus having a photoreceptor according to embodiments of the present invention.

Next, referring to the accompanying drawings, a description is made of embodiments of the present invention. In the figures, parts the same as or similar to each other are designated by the same reference numerals, and the description thereof is not repeated accordingly.

FIG. 1 is a schematic diagram showing a configuration of an image forming apparatus having a photoreceptor according to the embodiments of the present invention. Referring to FIG. 1, the image forming apparatus 100 includes the photoreceptor 1, a destaticizing lamp 2, an electrifying charger 3, an image exposure section 5, a development unit 6, a pre-transfer charger 7, rollers 8, a transfer charger 10, a separation charger 11, a separation claw 12, a pre-cleaning charger 13, a fur brush 14, and a cleaning blade 15.

The photoreceptor 1 is a medium for forming an electrostatic latent image. The destaticizing lamp 2 removes the charges on the photoreceptor 1. The electrifying charger 3 is composed of a corotron device, a scorotron device, a solid electric discharge element, a needle electrode device, a roller charging device, a conductive brush device, and the like. The electrifying charger 3 uniformly charges the surface of the photoreceptor 1.

The image exposure section 5 is composed of a fluorescent lamp, a tungsten lamp, a halogen lamp, a mercury lamp, a sodium lamp, a light-emitting diode (LED), a laser diode (LD), an electro luminescence (EL) light, and the like and forms an electrostatic latent image on the photoreceptor 1. To irradiate only a desired wavelength area, the image exposure section 5 includes various filters such as a sharp-cut filter, a band-path filter, a near-infrared cut filter, a dichroic filter, an interference filter, and a color temperature conversion filter.

The development unit 6 develops the electrostatic latent image formed on the photoreceptor 1. As a development method, a single-component development method using dry toner, a two-component development method, and a wet development method using wet toner are available. When a positive (negative) charge is applied to the photoreceptor 1 to perform image exposure, a positive (negative) electrostatic latent image is formed on the surface of the photoreceptor 1. If this is developed by negative polarity toner (detection fine particle), a positive image is obtained. On the other hand, if this is developed by positive polarity toner, a negative image is obtained.

The pre-transfer charger 7 is used to prepare to perform a transfer operation. As a transfer method, an electrostatic transfer method using a transfer charger and a bias roller, a mechanical transfer method such as an adhesion transfer method and a pressure transfer method, and an electromagnetic transfer method are available. As the electrostatic transfer method, a method using the electrifying charger 3 is available.

The rollers 8 introduce the transfer body 9 into the transfer charger 10. The transfer charger 10 transfers the toner image developed on the photoreceptor 1 onto the transfer body 9. The separation charger 11 separates the transfer body 9 from the photoreceptor 1. The separation claw 12 serves in the same manner as the separation charger 11.

The pre-cleaning charger 13 efficiently performs a cleaning operation. The fur brush 14 cleans the toner left on the photoreceptor 1 after the transfer. The cleaning blade 15 serves in the same manner as the fur brush 14.

Figure 2:
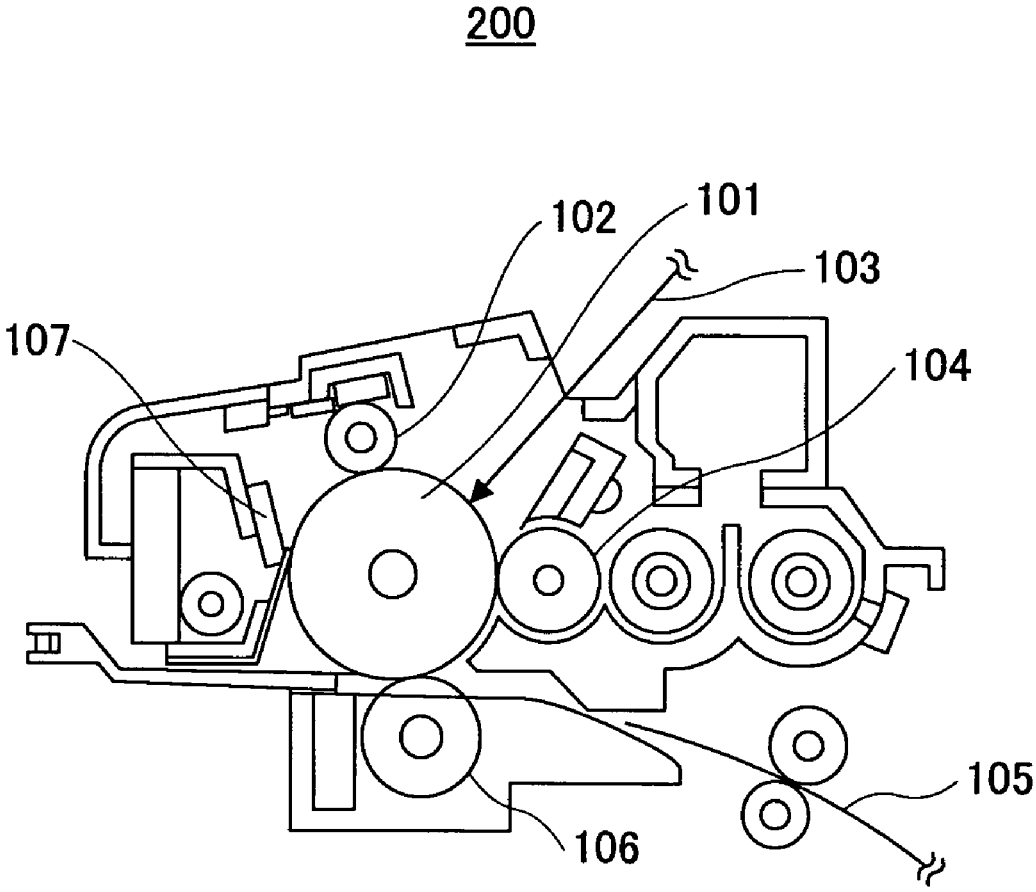
FIG. 2 is a schematic diagram showing a configuration of a process cartridge having the photoreceptor according to the embodiments of the present invention.

FIG. 2 is a schematic diagram showing a configuration of a process cartridge having the photoreceptor according to the embodiments of the present invention. Referring to FIG. 2, the process cartridge 200 includes a photoreceptor 101, a charging unit 102, an exposure unit 103, a development unit 104, a transfer unit 106, and a cleaning unit 107.

The photoreceptor 101 is a medium for forming an electrostatic latent image. The charging unit 102 charges the surface of the photoreceptor 101. The exposure unit 103 forms an electrostatic latent image on the photoreceptor 101. The development unit 104 develops the electrostatic latent image with toner. The transfer unit 106 transfers the toner image to the transfer body 105. The cleaning unit 107 cleans the surface of the photoreceptor 101 after the transfer of the image.

Figure 3:
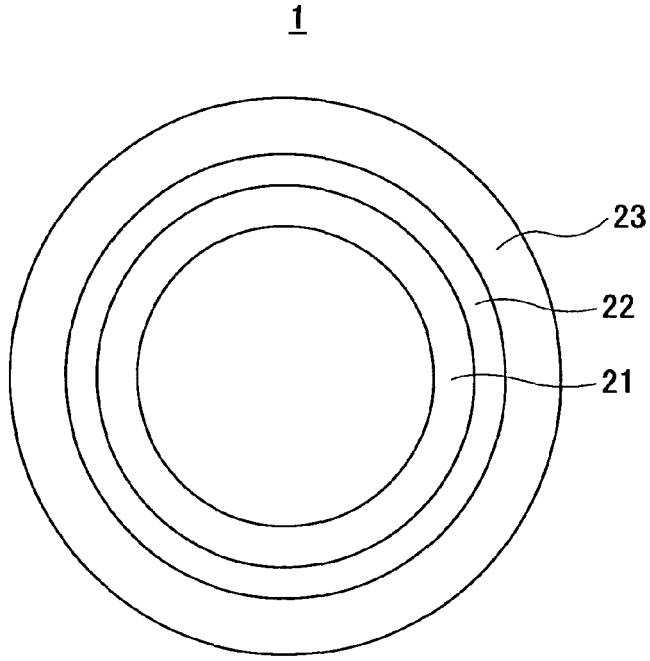
FIG. 3 is a cross-sectional view of the photoreceptor 1 shown in FIG. 1.

FIG. 3 is a cross-sectional view of the photoreceptor 1 shown in FIG. 1. Referring to FIG. 3, the photoreceptor 1 includes a conductive support body 21, an intermediate layer 22, and a photosensitive layer 23. The conductive support body 21 is made, for example, of aluminum and has a substantially cylindrical shape. The conductive support body 21 has a diameter of, for example, 30 mm.

The intermediate layer 22 is made of a layer obtained by dispersing gallium nitride (GaN) particles in a binder resin properly selected or gallium nitride crystals and is formed on the surface of the conductive support body 21. The intermediate layer 22 has a film thickness of 0.1 through 5 μm and preferably 1 through 3.5 μm. The intermediate layer 22 suppresses not only the injection of charges (holes) and the occurrence of moires from the conductive support body 21 but also the flow of charges (electrons) from the conductive support body 21 to the photosensitive layer 23. The photosensitive layer 23 is made of a single-layer type photosensitive layer or a laminated type photosensitive layer and formed on the intermediate layer 22.

Where the photosensitive layer 23 is made of the laminated type photosensitive layer, it includes a charge generation layer and a charge transfer layer. The charge generation layer is formed on the surface of the intermediate layer 22. The charge transfer layer is formed on the charge generation layer.

The charge generation layer contains as a main component a charge generation substance having a function of generating charges and additionally contains a binder resin as required. The charge generation substance is made of inorganic materials or organic materials.

Examples of the inorganic materials include crystalline selenium, amorphous selenium, selenium-tellurium, selenium-tellurium-halogen, selenium-arsenic compound, amorphous silicon, or the like. As the amorphous silicon, there is preferably used one obtained by terminating dangling bonds with hydrogen atoms or halogen atoms or by being doped with boron atoms, phosphorous atoms, or the like.

As the organic materials, known materials may be used. Specific examples are phthalocyanine system pigments such as metal phthalocyanine and nonmetal phthalocyanine, azlenium salt pigments, squaric acid methine pigments, azo pigments having a carbazole skeleton, azo pigments having a triarylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having an distyryl oxadiazole skeleton, azo pigments having a distyryl carbazole skeleton, perylene pigments, anthraquinone system or polycylic quinone system pigments, quinone imine system pigments, diphenylmethane and triphenylmethane system pigments, benzoquinone and naphthoquione system pigmens, cyanine and azomethine system pigments, indigoid system pigments, bisbenzimidazole system pigments, or the like. These charge generation substances may be used alone or in combination of a mixture of two or more.

Examples of the binder resin used in the charge generation layer as required include polyamide, polyurethane, epoxy resin, or the like. These binder resins may be used alone or in combination of a mixture of two or more. The amount of the binder resin is in the range of 0 through 500 parts by weight and preferably 10 through 300 parts by weight relative to 100 parts by weight of the charge generation substance. The binder resin may be added to the charge generation layer before or after the dispersion of gallium nitride (GaN) particles.

The methods of forming the charge generation layer may be roughly divided into vacuum thin film forming methods and casting methods that use a solution dispersion system. The vacuum thin film forming methods include such methods as a vacuum deposition method, a glow discharge decomposition method, an ion plating method, a sputtering method, an reaction sputtering method, and a CVD (Chemical Vapor Deposition) method. The above inorganic and organic materials may be preferably formed using these methods.

In order to form the charge generation layer using the casting methods, the inorganic or organic charge generation substances are dispersed in a solvent such as tetrahydrofuran, dioxane, dioxolan, toluene, dichloromethane, monochlorobenzene, dichloroethane, cyclohexanone, cyclopentanone, anisole, xylene, methylethyl ketone, acetone, ethyl acetate, and butyl acetate by means of a ball mill, an attritor, a sand mill, a bead mill, or the like and then the dispersed liquid is appropriately diluted and coated. In this case, the binder resin may be added to the charge generation layer as required. Furthermore, leveling agents such as dimethyl silicon oil and phenyl silicon oil may also be added to the charge generation layer as required. The coating may be performed using a dip coating method, a spray coating method, a bead coating method, a ring coating method, or the like.

The film thickness of the charge generation layer is in the range of about 0.01 through 5 μm and preferably 0.05 through 2 μm.

The charge transfer layer includes a charge transfer mechanism and contains as a main component a charge transfer substance and a binder resin. Examples of the charge transfer substance include a hole transfer substance and an electron transfer substance. As the charge transfer substance used in the surface layer of the charge transfer layer, compounds having a charge transfer structure may be mainly used. Examples of the charge transfer structure include a hole transfer structure such as triarylamine, hydrazone, pyrazoline, carbazole or the like and an electron transfer structure of an electron attraction aromatic ring having, for example, condensed polycylic quinone, diphenoquinone, and a cyano group or a nitro group.

As the binder resin, thermoplastic or thermosetting resins such as polystyrene, styrene-acrylonitrile copolymer, styrene-buthadiene copolymer, styrene-maleic anhydride copolymer, and polyester may be used.

Examples of the electron transfer substance include electron accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-One, 1,3,7-trinitrodibenzothiophene-5,5-dioxide, and a diphenoquinone derivative. These electron transfer substances may be used alone or in combination of a mixture of two or more.

Examples of the hole transfer substance include poly-N-vinylcarbazole and its derivative, poly-γ-carbazolylethylglutamate and its derivative, pyrene-formaldehyde condensate and its derivative, polyvinylpyrene, polyvinylphenanthrene, polysilane, oxazole derivative, oxadiazole derivative, imidazole derivative, monoarylamine derivative, diarylamine derivative, triarylamine derivative, stilbene derivative, α-phenylstilbene derivative, bendizine derivative, diarylmethane derivative, triarylmethane derivative, 9-strylanthracene derivative, pyrazoline derivative, divinylbenzene derivative, hydrazone derivative, indene derivative, butadiene derivative, pyrene derivative, bisstilben derivative, enamine derivative, or known materials. These charge transfer substances may be used alone or in combination of a mixture of two or more.

The amount of the charge transfer substance is in the range of 20 through 300 parts by weight and preferably 40 through 150 parts by weight relative to the binder resin of 100 parts by weight. However, where a high-molecular charge transfer substance is used, it may be used alone or in combination with the binder resin.

The solvent used here includes tetrahydrofluan, dioxane, toluene, dichloromethane, monochlorobenzene, dichloroethane, cyclohexane, methylethyl ketone, acetone, or the like. These solvents may be used alone or in combination of a mixture of two or more.

Furthermore, plasticizing agents or leveling agents may be added to the solvent. As the plasticizing agents used in the charge transfer layer, dibutylphthalate and dioctylphthalate used as general resinous plasticizing agents may be used as they are, and their usage amount is preferably in the range of 0 through 30 parts by weight relative to 100 parts by weight of the binder resin. As the leveling agents that can be used in the charge transfer layer, silicon oil such as dimethyl silicon oil and methylphenyl silicon oil and a polymer or an oligomer having a perfluoroalkyl group on the side chain may be used, and their usage amount is preferably in the range of 0 through 1 part by weight relative to 100 parts by weight of the binder resin.

From the viewpoint of resolution and response, the film thickness of the charge transfer layer is preferably 40 μm or smaller and more preferably 25 μm or smaller. Although its lower limit varies depending on a system to be used (particularly, charge potential, etc.), it is preferably 5 μm or larger.

Where the photosensitive layer 23 is a single layer, it includes not only a charge generation function but also a charge transfer function. In this case, the photosensitive layer 23 is formed by dissolving or dispersing a charge generation substance, a charge transfer substance, and a binder resin in an appropriate solvent and then coating and drying the same. Furthermore, a plasticizing agent, a leveling agent, and an antioxidizing agent are added as required to form the photosensitive layer 23.

As the binder resin, the binder resin used in the charge transfer layer and that used in the charge generation layer may be used in combination. Furthermore, the high-molecular charge transfer substance described above may be preferably used. Relative to 100 parts by weight of the binder resin, the amount of the charge generation substance is preferably in the range of 5 through 40 parts by weight and the amount of the charge transfer substance is preferably in the range of 0 through 190 parts by weight and more preferably in the range of 50 through 150 parts by weight. The photosensitive layer 23 is formed by coating the coating liquid obtained by dispersing the charge generation substance and the binder resin in a solvent such as tetrahydrofuran, dioxane, dichloroethane, and cyclohexane by means of a dispersion machine under the dip coating method, the spray coating method, the bead coating method, and the ring coating method. The film thickness of the photosensitive layer 23 is preferably in the range of 5 through 25 μm.

Figure 4:
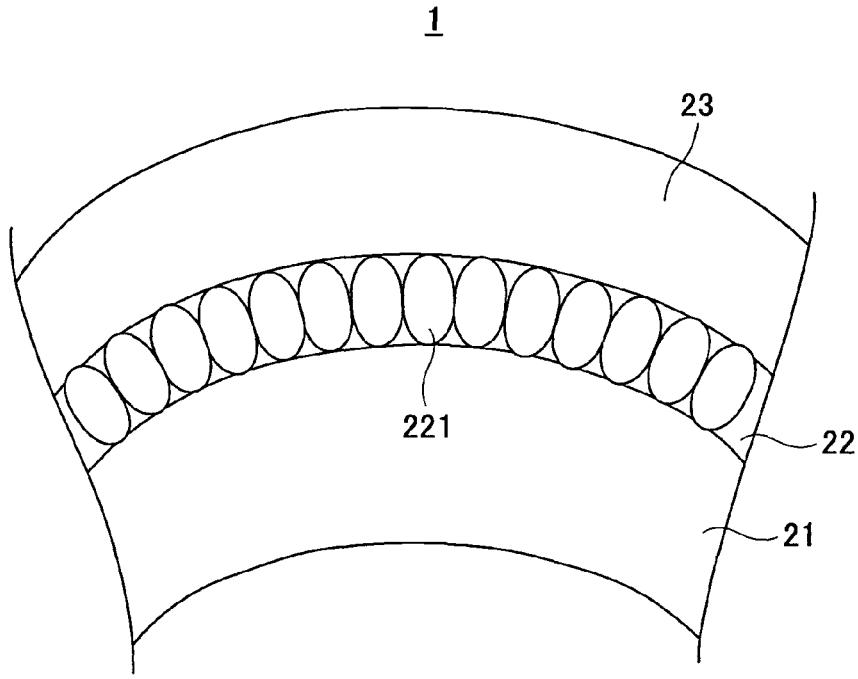
FIG. 4 is a partial enlarged view of the photoreceptor 1 shown in FIG. 3.

FIG. 4 is a partial enlarged view of the photoreceptor 1 shown in FIG. 3. Referring to FIG. 4, the intermediate layer 22 is made of plural crystal grains 221, and each of the crystal grains 221 is composed of GaN crystals having a grain diameter of 1 μm or larger. Note that the grain diameter of GaN crystals may be 1 μm or smaller. Each of the plural crystal grains 221 is in contact with the conductive support body 21 and the photosensitive layer 23. In other words, charges (electrons) are capable of moving from the photosensitive layer 23 to the conductive support body 21 without passing through a grain boundary.

Note that the photoreceptor 101 shown in FIG. 2 has the same structure as that of the photoreceptor 1 shown in FIGS. 3 and 4.

Figure 5:
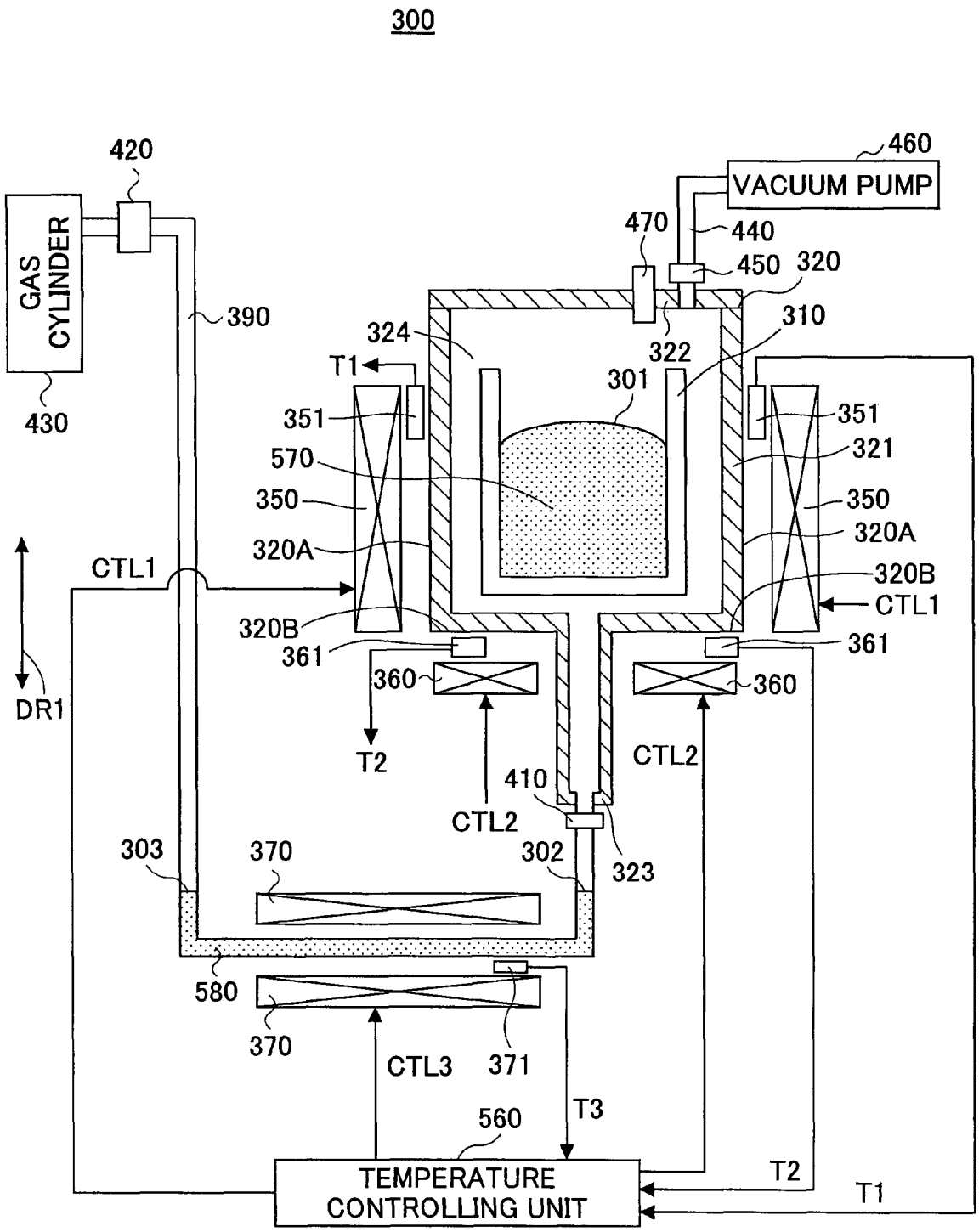
FIG. 5 is a schematic diagram of a crystal production apparatus that produces GaN crystals to be used in an intermediate layer of the photoreceptor.

GaN crystals are produced, for example, by a flux method. FIG. 5 is a schematic diagram of a crystal production apparatus that produces GaN crystals to be used in the intermediate layer 22 of the photoreceptors 1 and 101. Referring to FIG. 5, the crystal production apparatus 300 includes a crucible 310, a reaction vessel 320, heating units 350, 360, and 370, temperature sensors 351, 361, and 371, a gas supply pipe 390, valves 410 and 450, a pressure regulator 420, a gas cylinder 430, an exhaust pipe 440, a vacuum pump 460, a pressure sensor 470, a temperature controlling unit 560, and an alkali metal melt 580.

The crucible 310 is of a substantially cylindrical shape and made of boron nitride (BN) or SUS316L. The reaction vessel 320 is arranged on the periphery of the crucible 310 at a predetermined gap with the crucible 310. In other words, the reaction vessel 320 has the crucible 310 inside it. The reaction vessel 320 is composed of a main body part 321, a cover part 322, and a pipe connection part 323. The main body part 321, the cover part 322, and the pipe connection part 323 are made of SUS316L, and the part between the main body part 321 and the cover part 322 is sealed by a metal O-ring. The pipe connection part 323 is provided at the bottom surface of the main body part 321.

The heating units 350 are arranged so as to enclose an outer peripheral surface 320A of the reaction vessel 320. The heating units 360 are arranged opposite to a bottom surface 320B of the reaction vessel 320. The heating units 370 are arranged opposite to a part of the gas supply pipe 390. The temperature sensors 351, 361, and 371 are arranged near the heating units 350, 360, and 370, respectively.

The gas supply pipe 390 has one end connected to the pipe connection part 323 of the reaction vessel 320 and the other end connected to the gas cylinder 430 through the pressure regulator 420. The valve 410 is attached to the gas supply pipe 390 near the pipe connection part 323.

The pressure regulator 420 is attached to the gas supply pipe 390 near the gas cylinder 430. The gas cylinder 430 is connected to the gas supply pipe 390.

The exhaust pipe 440 has one end connected to the reaction vessel 320 through the valve 450 and the other end connected to the vacuum pump 460. The valve 450 is attached to the exhaust pipe 440 near the reaction vessel 320. The vacuum pump 460 is connected to the other end of the exhaust pipe 440.

The pressure sensor 470 is attached to the reaction vessel 320.

The alkali metal melt 580 is made of a metal sodium (metal Na) melt and held in a part of the gas supply pipe 390.

The crucible 310 holds a mixed melt 570 containing metal Na and metal gallium (metal Ga). The reaction vessel 320 covers the periphery of the crucible 310. The heating units 350 are composed of a heater and a current source. The heating units 350 supply current to the heater from the current source in accordance with the control signal CTL1 from the temperature controlling unit 560 so as to heat the crucible 310 and the reaction vessel 320 from the outer peripheral surface 320A of the reaction vessel 320 to crystal growth temperature. Each of the temperature sensors 351 detects the temperature T1 of the heater of the heating unit 350 and outputs the detected temperature T1 to the temperature controlling unit 560.

Similarly, the heating units 360 are composed of the heater and the current source. The heating units 360 supply current to the heater from the current source in accordance with the control signal CTL2 from the temperature controlling unit 560 so as to heat the crucible 310 and the reaction vessel 320 from the bottom surface 320B of the reaction vessel to the crystal growth temperature. Each of the temperature sensors 361 detects the temperature T2 of the heater of the heating unit 360 and outputs the detected temperature T2 to the temperature controlling unit 560.

Furthermore, the heating units 370 are also composed of the heater and the current source. The heating units 370 supply current to the heater from the current source in accordance with the control signal CTL3 from the temperature controlling unit 560 so as to heat a part of the gas supply pipe 390 to a temperature at which metal Na is not substantially vaporized. Here, the temperature at which Na is not substantially vaporized is, for example, in the range of 200° C. through 300° C. The vapor pressure of Na at 200° C. is about $1.8\times10^{-2}$ Pa, and the vapor pressure of Na at 300° C. is about 1.8 Pa. Accordingly, the heating units 370 suppress the substantial vaporization of metal Na and heat a part of the gas supply pipe 390 to 200° C. through 300° C. so that the alkali metal melt 580 (metal Na melt) is held in the part of the gas supply pipe 390 in a liquid state.

The temperature sensor 371 detects the temperature T3 of the heater of the heating unit 370 and outputs the detected temperature T3 to the temperature controlling unit 560.

The gas supply pipe 390 supplies nitrogen gas introduced from the gas cylinder 430 through the pressure regulator 420 to the reaction vessel 320 through the alkali metal melt 580. The valve 410 is used to supply the nitrogen gas in the gas supply pipe 390 to the reaction vessel 320 or stop supplying the nitrogen gas thereto. Furthermore, the valve 410 is used to separate the gas supply pipe 390 from the pipe connection part 323 or connect the gas supply pipe 390 and the pipe connection part 323 to each other. The pressure regulator 420 supplies the nitrogen gas from the gas cylinder 430 to the gas supply pipe 390 after setting it at a predetermined pressure.

The gas cylinder 430 holds nitrogen gas. The exhaust pipe 440 allows the gas in the reaction vessel 320 to pass through to the vacuum pump 460. The valve 450 is used to make the reaction vessel 320 and the exhaust pipe 440 spatially connected to each other or make them spatially separated from each other. The vacuum pump 460 evacuates the reaction vessel 320 through the exhaust pipe 440 and the valve 450.

The pressure sensor 470 detects the pressure in the reaction vessel 320. The temperature controlling unit 560 receives the temperatures T1 through T3 from the temperature sensors 351, 361, and 371, respectively, and generates the control signals CTL1 through CTL3 in accordance with the received temperatures T1 through T3, respectively. More specifically, the temperature controlling unit 560 generates the control signal CTL1 for heating the crucible 310 and the reaction vessel 320 to the crystal growth temperature in accordance with the temperature T1 from the temperature sensors 351 and generates the control signal CTL2 for heating the crucible 310 and the reaction vessel 320 to the crystal growth temperature in accordance with the temperature T2 from the temperature sensors 361. Furthermore, the temperature controlling unit 560 generates the control signal CTL3 for heating the part of the gas supply pipe 390 to the temperature at which Na is not substantially vaporized in accordance with the temperature T3 from the temperature sensor 371.

Then, the temperature controlling unit 560 outputs the generated control signals CTL1, CTL2, and CTL3 to the heating units 350, 360, and 370, respectively.

Figure 6:
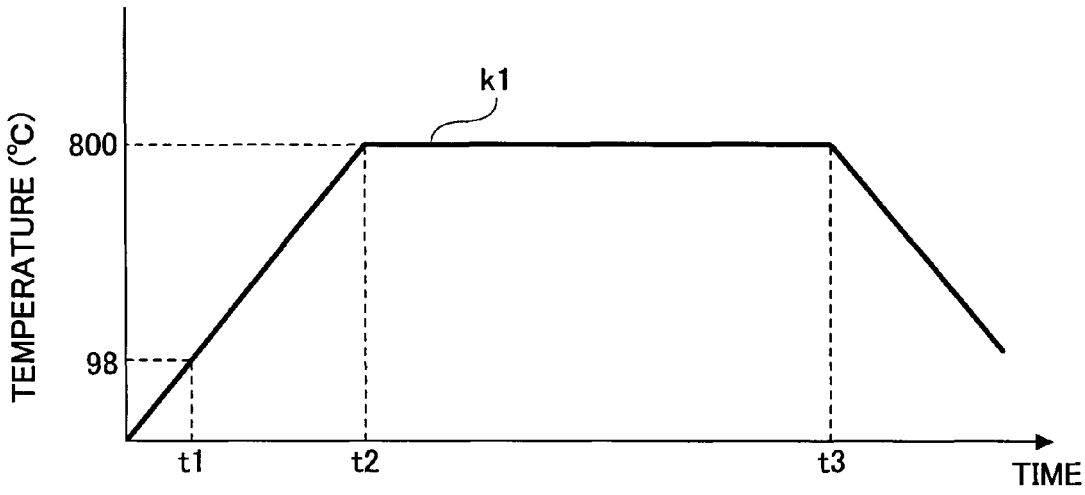
FIG. 6 is a timing chart showing the temperatures of a crucible and a reaction vessel shown in FIG. 5.
Figure 7B:
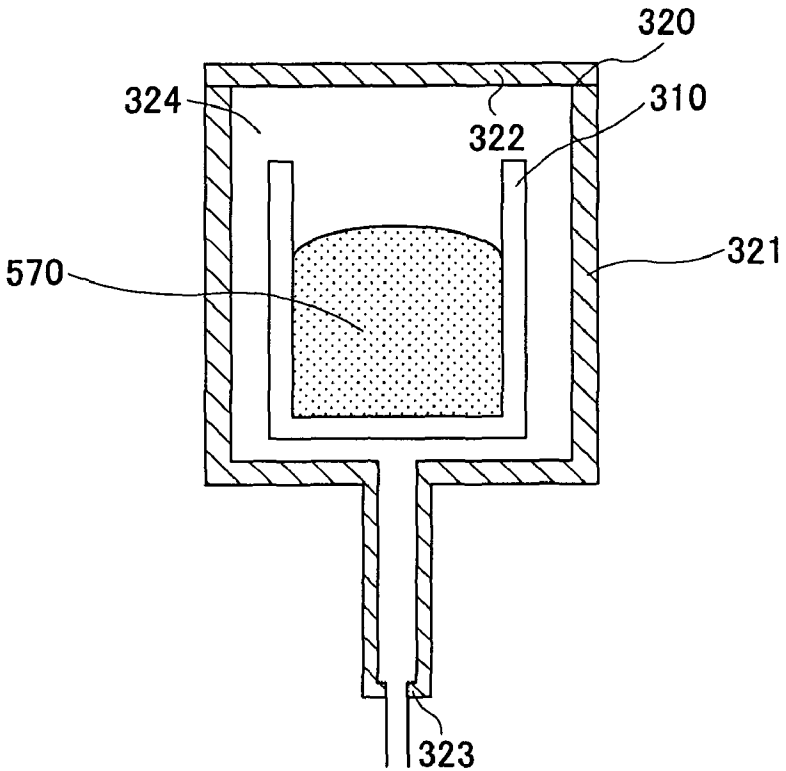
FIGS. 7A and 7B are schematic diagrams showing the change of state in the crucible and the reaction vessel in a period between the timings t1 and t2 shown in FIG. 6.
Figure 7A:
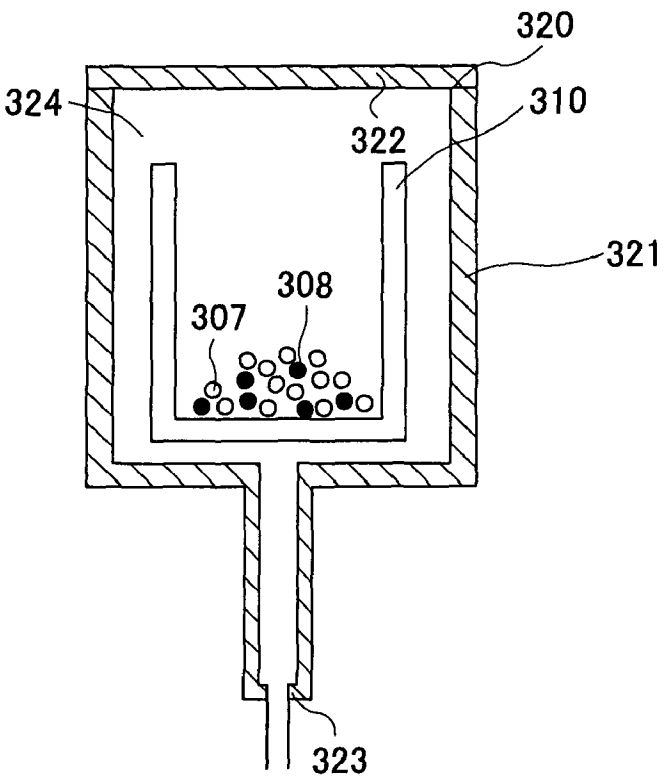
Figure 8A:
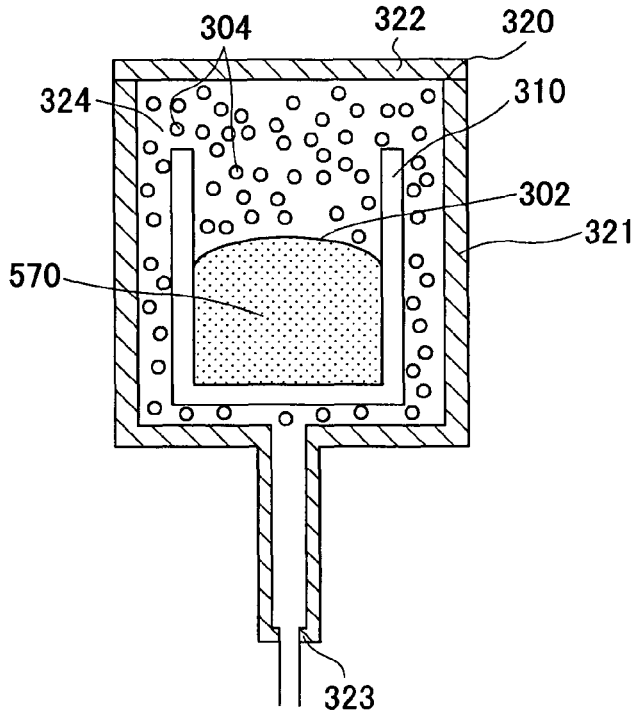
FIGS. 8A and 8B are schematic diagrams showing the change of state in the crucible and the reaction vessel in a period between the timings t2 and t3.
Figure 8B:
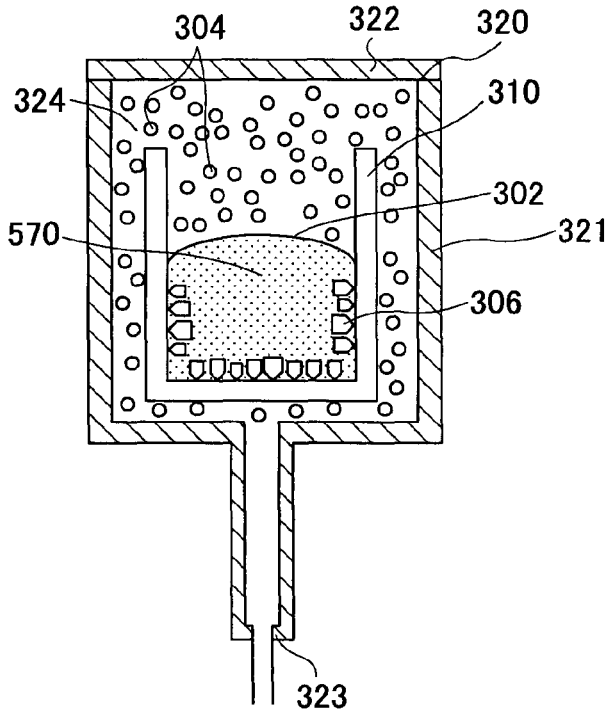

FIG. 6 is a timing chart showing the temperatures of the crucible 310 and the reaction vessel 320 shown in FIG. 5. FIGS. 7A and 7B are schematic diagrams showing the change of state in the crucible 310 and the reaction vessel 320 in a period between the timings t1 and t2 shown in FIG. 6. FIGS. 8A and 8B are schematic diagrams showing the change of state in the crucible 310 and the reaction vessel 320 in a period between the timings t2 and t3. Note that the bold line k1 shows the temperatures of the crucible 310 and the reaction vessel 320 in FIG. 6.

As shown in FIG. 6, the heating units 350 and 360 heat the crucible 310 and the reaction vessel 320 so that the temperature is raised in accordance with the bold line k1 and kept at 800° C. until timing t3.

When the heating units 350 and 360 start heating the crucible 310 and the reaction vessel 320, the metal Na 307 and the metal Ga 308 are present in the crucible 310 (see FIG. 7A). Then, when the temperatures of the crucible 310 and the reaction vessel 320 reach 98° C. at timing t1, the metal Na 307 in the crucible 310 is melted and mixed with the metal Ga 308 that has been melted at about 30° C. Subsequently, the intermetallic compound of the Ga and the Na is generated. The intermetallic compound is formed into a mixed melt 570 in the crucible 310 at a temperature of 560° C. or higher. Then, the temperatures of the crucible 310 and the reaction vessel 320 reach 800° C. at timing t2.

In a process in which the crucible 310 and the reaction vessel 320 are heated to 800° C., the vapor pressure of the metal Na vaporized from the mixed melt 570 is gradually increased and the vaporized Na is accumulated and condensed in the low-temperature area of the gas supply pipe 390 as the alkali metal melt 580. As a result, the alkali metal melt 580 is generated at the part of the gas supply pipe 390 to form gas-liquid interfaces 302 and 303.

Then, the mixed melt 570 is generated in the crucible 310 at timing t2 (see FIG. 7B). Furthermore, the pressure of the nitrogen gas 304 is regulated by the pressure regulator 420, and the nitrogen gas 304 flows into and fills a space 324 through the gas supply pipe 390 (see FIG. 8A).

When the crucible 310 and the reaction vessel 320 are heated to about 800° C., the nitrogen gas 304 in the space 324 is taken into the mixed melt 570 through the metal Na as a medium. Then, the concentration of the nitrogen or $Ga_xN_y$ (x and y indicating actual numbers) in the mixed melt 570 is increased to grow GaN crystals 306 at the interface between the crucible 310 and the mixed melt 570 (see FIG. 8B). Note that the $Ga_xN_y$ is referred to as a "group III nitride" and the concentration of the $Ga_xN_y$ is referred to as a "group III nitride concentration" according to the embodiments of the present invention.

Figure 9:
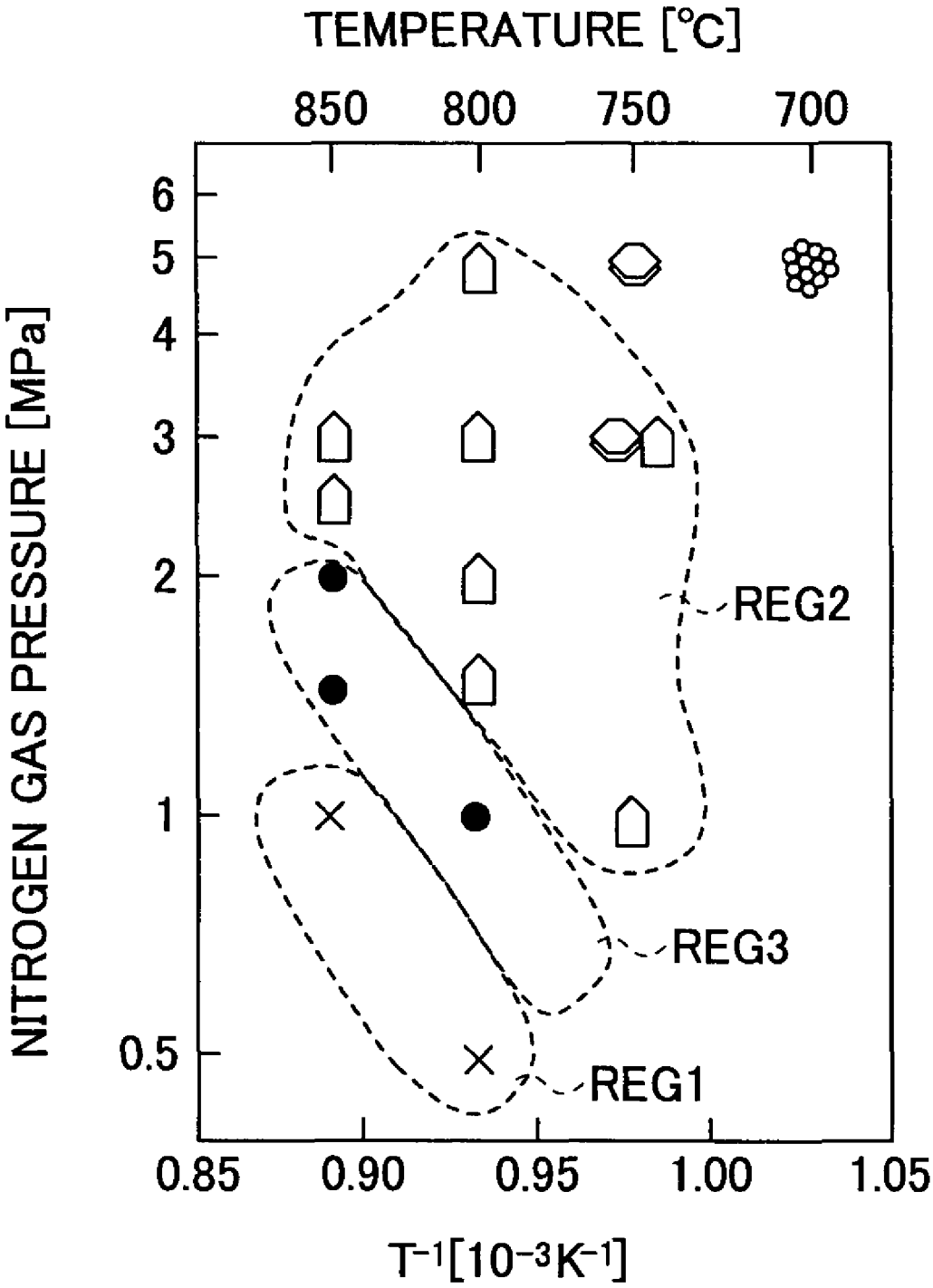
FIG. 9 is a drawing showing a relationship between nitrogen gas pressure and crystal growth temperature when GaN crystals are grown.

FIG. 9 is a drawing showing a relationship between nitrogen gas pressure and crystal growth temperature when GaN crystals are grown. In FIG. 9, the horizontal axis represents the crystal growth temperature and the vertical axis represents the nitrogen gas pressure. Furthermore, REG1 is a region where GaN crystals dissolve, REG2 is a region where many nuclei form on the bottom surface and the side surfaces in contact with the mixed melt 570 of the crucible 310 and column-shaped GaN crystals grown in the c-axis (<0001>) direction are produced, and REG3 is a region where GaN crystals grow from seed crystals.

According to the embodiments of the present invention, the GaN crystals 306 are grown using the temperatures and the pressures in the REG2.

Referring again to FIG. 6, when the crystal growth of the GaN crystals 306 is completed at timing t3, the heating units 350 and 360 stop heating the crucible 310 and the reaction vessel 320. Then, the temperatures of the crucible 310 and the reaction vessel 320 are lowered down from 800° C. in accordance with the bold line k1.

Figure 10:
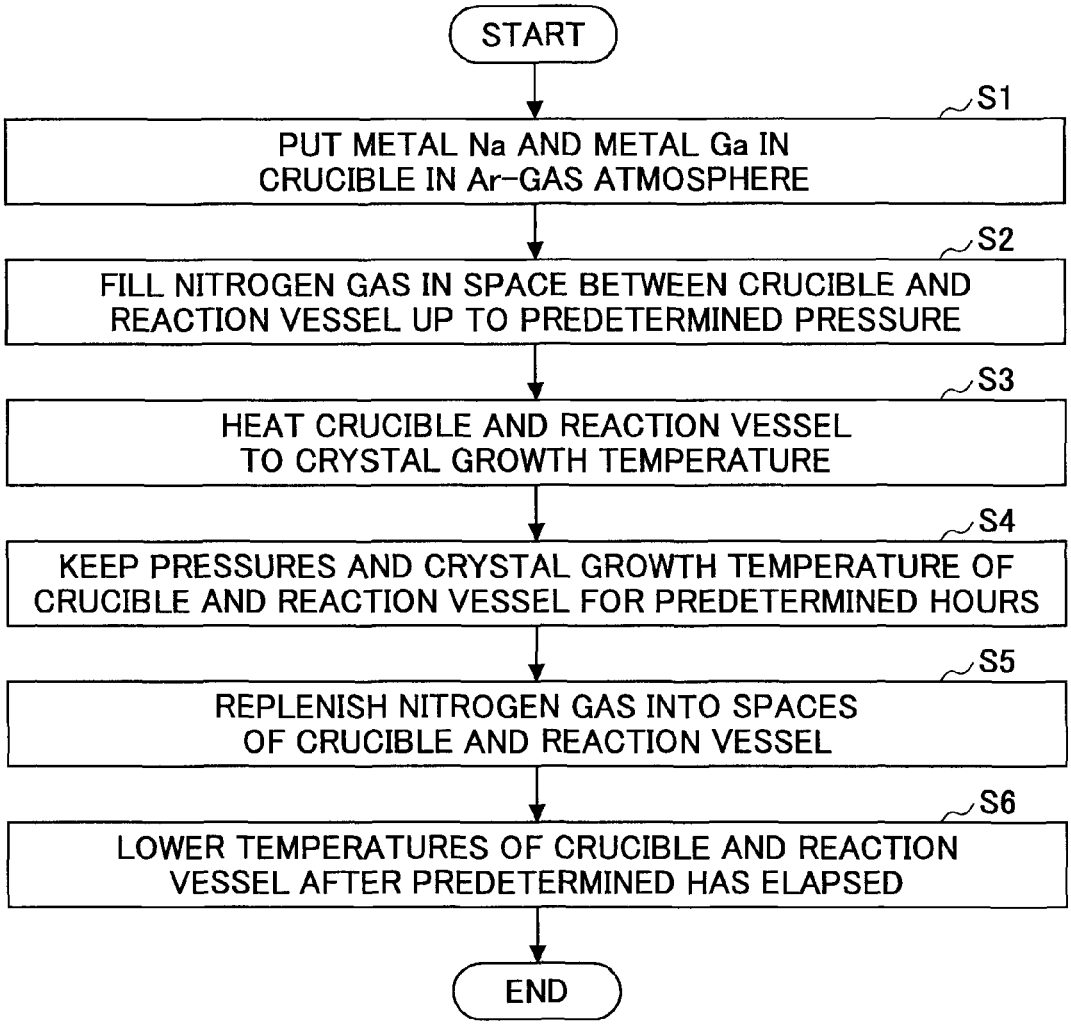
FIG. 10 is a flowchart for describing a method of producing GaN crystals.

FIG. 10 is a flowchart for describing a method of producing GaN crystals. Referring to FIG. 10, when a series of operations are started, the valve 410 is used to separate the gas supply pipe 390 from the pipe connection part 323, and the crucible 310, the reaction vessel 320, and the gas supply pipe 390 are put in a glove box filled with Ar gas. Then, the metal Na and the metal Ga are put in the crucible 310 in an Ar-gas atmosphere (step S1). In this case, the metal Na and the metal Ga are put in the crucible 310 in a mixture ratio of 5:5. Note that the Ar gas has a water amount of 1 ppm or smaller and an oxygen amount of 1 ppm or smaller (the same applies to the description below). Then, the crucible 310 in which the metal Na and the metal Ga are put is set in the reaction vessel 320. Subsequently, the crucible 310, the reaction vessel 320, and the gas supply pipe 390 are taken out from the glove box. Then, the crucible 310, the reaction vessel 320, and the gas supply pipe 390 are set in the crystal production apparatus 300 while they are filled with Ar gas.

Next, the valve 410 is used to connect the gas supply pipe 390 and the pipe connection part 323 to each other. Then, the valve 450 is opened to cause the vacuum pump 460 to evacuate the Ar gas filling in the crucible 310, the reaction vessel 320, and the gas supply pipe 390 with the valve 410 closed. After the crucible 310, the reaction vessel 320, and the gas supply pipe 390 are evacuated down to a predetermined pressure (0.133 Pa or smaller) by the vacuum pump 460, the valve 450 is closed and the valve 410 is opened to thereby supply the nitrogen gas from the gas cylinder 430 to the crucible 310 and the reaction vessel 320 through the gas supply pipe 390. In this case, the nitrogen gas is supplied to the crucible 310 and the reaction vessel 320 with the pressure regulator 420 so that the pressures in the crucible 310 and the reaction vessel 320 become about 0.1 MPa.

When the pressure in the reaction vessel 320 detected by the pressure sensor 470 becomes about 0.1 MPa, the valve 410 is closed and the value 450 is opened to cause the vacuum pump 460 to evacuate the nitrogen gas filling the crucible 310, the reaction vessel 320, and the gas supply pipe 390. In this case also, the crucible 310, the reaction vessel 320, and the gas supply pipe 390 are evacuated down to a predetermined pressure (0.133 Pa or smaller) by the vacuum pump 460.

Then, the evacuation of the crucible 310, the reaction vessel 320, and the gas supply pipe 390 and the supplying of the nitrogen gas to the crucible 310, the reaction vessel 320, and the gas supply pipe 390 are alternately repeated several times.

Subsequently, after the crucible 310, the reaction vessel 320, and the gas supply pipe 390 are evacuated down to the predetermined pressure by the vacuum pump 460, the valve 450 is closed and the valve 410 is opened to thereby supply the nitrogen gas to the crucible 310, the reaction vessel 320, and the gas supply pipe 390 with the pressure regulator 420 so that the pressures in the crucible 310, the reaction vessel 320, and the gas supply pipe 390 become 2.02 MPa (step S2).

Then, the crucible 310 and the reaction vessel 320 are heated to 800° C. (i.e., crystal growth temperature) by the heating units 350 and 360 (step S3). As a result, in a process in which the crucible 310 and the reaction vessel 320 are heated to 800° C., the metal Na and the metal Ga in the crucible 310 also become liquid, thereby causing the mixed melt 570 of the metal Na and the metal Ga to be formed in the crucible 310.

Then, the temperatures of the crucible 310 and the reaction vessel 320 are kept at 800° C. for predetermined hours (several hours) (step S4).

Accordingly, the GaN crystals 306 are grown at the side surfaces and the bottom surface of the crucible 310. As the growth of GaN crystals progresses, the nitrogen gas in the space 324 is consumed to thereby reduce the nitrogen gas in the space 324. Then, the pressure P1 in the space 324 becomes lower than the pressure P2 in the gas supply pipe 390 on the side of the pressure regulator 420 (P1<P2) to generate a differential pressure between the space 324 and the gas supply pipe 390 (on the side of the pressure regulator 420). As a result, the nitrogen gas in the gas supply pipe 390 is supplied to the space 324 through the alkali metal melt 580 (i.e., metal Na melt). In other words, the nitrogen gas is replenished by the flow into the spaces of the crucible 310 and the reaction vessel 320 (step S5). Accordingly, the GaN crystals 306 are continuously grown in the crucible 310.

Then, after the predetermined hours have elapsed, the temperatures of the crucible 310 and the reaction vessel 320 are lowered (step S6), thus completing the production of the GaN crystals. Furthermore, the GaN crystals produced in accordance with the flowchart shown in FIG. 10 are free from dislocation (i.e., the crystals are never dislocated and extremely high in quality).

Although the crystal growth temperature is set at 800° C. in the description of FIG. 10, the present invention is not limited to this. The crystal growth temperature may be within the REG 2 shown in FIG. 9. Furthermore, the nitrogen gas pressure may be within the REG 2 shown in FIG. 9.

Furthermore, although the metal Na and the metal Ga are put in the crucible 310 in an Ar-gas atmosphere in the above description, the present invention is not limited to this. Alternatively, the metal Na and the metal Ga may be put in the crucible 310 in gas other than Ar gas such as He, Ne, and Kr or a nitrogen gas atmosphere. In general, the metal Na and the metal Ga may be put in the crucible 310 in an inert gas or a nitrogen gas atmosphere. In this case, the inert gas or the nitrogen gas has a water amount of 1 ppm or smaller and an oxygen amount of 1 ppm or smaller.

The GaN crystals produced by the above method are processed into crystal grains having a grain diameter of 1 μm or larger. The plural processed crystal grains are dispersed in a binder properly selected so as to be coated on the conductive support body 21, thereby forming the intermediate layer 22. The binder is not particularly limited so long as it is an insulating resin. However, solvent coating materials are used to coat the photosensitive layer if the photosensitive layer to be formed on the intermediate layer is a single layer or used to coat the charge generation layer and the charge transfer layer if it is a laminated type. Therefore, it is desirable to use one having no resolubility to general organic solvents. Examples of the resin include water-soluble resins such as polyvinyl alcohol, casein, and sodium polyacrylate; alcohol-soluble resins such as copolymer nylon and methoxymethylated nylon; and hardening resins having three-dimensional network structures such as polyurethane, a melamine resin, a phenol resin, an alkyd-melamine resin, and an epoxy resin.

The, after the intermediate layer 22 is formed, the photosensitive layer 23 (single-layer type photosensitive layer or laminated type photosensitive layer) is formed on the intermediate layer 22 in the above manner to thereby manufacture the photoreceptors 1 and 101.

Alternatively, the obtained GaN crystal grains are sprayed on the conductive support body 21 by plasma spraying to form the intermediate layer 22. Thus, it is also possible to manufacture the photoreceptors 1 and 101.

Since GaN crystals are applied to the intermediate layer 22 to manufacture the photoreceptors 1 and 101 in the embodiments of the present invention as described above, the electron affinity of the intermediate layer 22 becomes greater than that of the photosensitive layer 23 in the photoreceptors 1 and 101. As a result, the intermediate layer 22 serves as a barrier layer with respect to the holes in the conductive support body 21 and smoothly transfers the electrons generated in the photosensitive layer 23 to the conductive support body 21.

Accordingly, it is possible to suppress the injections of holes from the conductive support body 21 to the photosensitive layer 23 according to the embodiments of the present invention. Since the GaN crystals are free from dislocation and no grain boundaries are present in an aroma from the photosensitive layer 23 to the conductive support body 21 at this time, charges are never trapped in defects and grain boundary.

Referring again to FIG. 1, the photoreceptor 1 is charged by the electrifying charger 3 while rotating in the counter clockwise direction and exposed by the image exposure section 5 to have an electrostatic latent image corresponding to an exposure image on its surface. Then, the electrostatic latent image is developed by the development unit 6 with toner, and the toner image is transferred onto the transfer body 9 by the transfer charger 10 and printed out. Subsequently, the surface of the photoreceptor 1 after the transfer of the image is cleaned by the fur brush 14 and the cleaning blade 15 and destaticized by the destaticizing lamp 2. Then, the above operations are repeated again so as to form images. Accordingly, the operations for forming images with the image forming apparatus 100 is completed.

Referring again to FIG. 2, the photoreceptor 101 is charged by the charging unit 102 while rotating in the clockwise direction and exposed by the exposure unit 103 to have an electrostatic latent image corresponding to an exposure image on its surface. Then, the electrostatic latent image is developed by the development unit 104 with toner, and the toner image developed is transferred onto the transfer body 105 by the transfer unit 106 and printed out. Subsequently, the surface of the photoreceptor 101 after the transfer of the image is cleaned by the cleaning unit 107 and destaticized by a destaticizing unit (not shown). Then the above operations are repeated again so as to form images. Accordingly, the operations for forming images with the process cartridge 200 is completed.

Note that the image forming apparatus according to the embodiments of the present invention requires only the photoreceptor 1. Furthermore, the process cartridge according to the embodiments of the present invention is configured only to include photoreceptor 101, have at least one of the charging unit 102, the development unit 104, the transfer unit 106, the cleaning unit 107, and the destaticizing unit, and be capable of being detached from the image forming apparatus.

Moreover, the crystal growth method for GaN crystals is not limited to the flux method using Na. Alternatively, a solution growth method or a melt growth method such as an ammonothermal method and a high-pressure solution method, a vapor-phase synthesis method, a laser ablasion method, etc., are available.

Next, a description is made of the present invention based on Examples in detail. However, the present invention is not limited to the Examples.

Example 1

(Method of Manufacturing Photoreceptor)

A coating liquid for the intermediate layer, a coating liquid for the charge generation layer, and a coating liquid for the charge transfer layer each having the following composition are sequentially coated and dried on an aluminum cylinder having a diameter of 30 mm and a plate aluminum to thereby form the intermediate layer having a film thickness of 1.5 μm, the charge generation layer having a film thickness of 0.2 μm, and the charge transfer layer having a film thickness of 18 μm. Accordingly, an electrophotographic photoreceptor is obtained that includes the conductive support body, the intermediate layer, the charge generation layer, and the charge transfer layer according to the embodiments of the present invention.

(Coating Liquid for Intermediate Layer)

6 parts by weight of an alkyd resin (BEKKOZOL 1307-60-EL manufactured by DAINIPPON INK AND CHEMICALS, INCORPORATED)

4 parts by weight of a melamine resin (SUPER BEKKAMIN G-821-60 manufactured by DAINIPPON INK AND CHEMICALS, INCORPORATED)

10 parts by weight of gallium nitride (having a volume average grain diameter of 1.5 μm)

10 parts by weight of methylethyl ketone (Coating Liquid for Charge Generation Layer)

2.5 parts by weight of a bisazo pigment having the following chemical formula (1)

0.5 part by weight of polyvinyl butyral (XYLH Manufactured by Union Carbide Corp.)

200 parts by weight of cyclohexanone 80 parts by weight of methylethyl ketone (Chemical Formula 1)

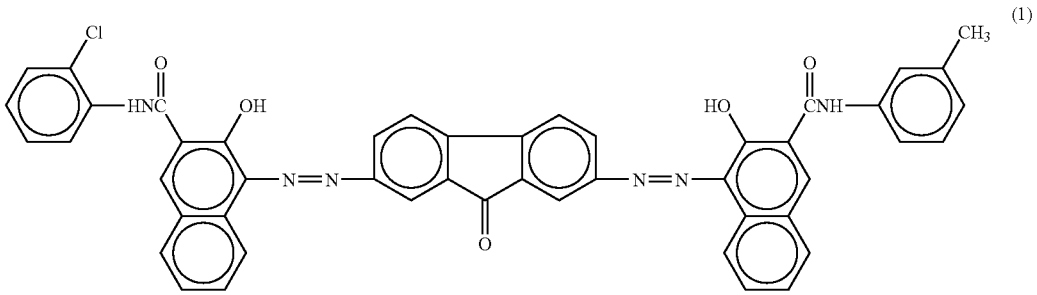

(Coating Liquid for Charge Transfer Layer)

10 parts by weight of bisphenol Z polycarbonate (Panlight TS-250 manufactured by Teijin Kasei Co.)

7 parts by weight of a low-molecular charge transfer substance having the following chemical formula (2)

100 parts by weight of tetrahydrofuran 1 part by weight of a tetrahydrofuran solution of 1% silicon oil (KF50-100CS manufactured by Shin-Etsu Chemical Co., Ltd.)

(Chemical Formula 2)

(2)

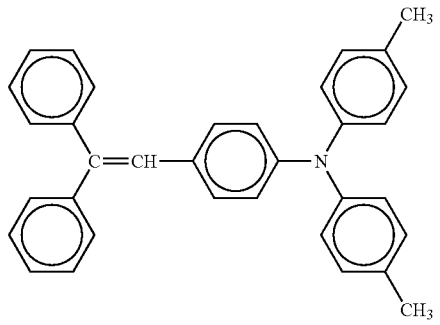

Example 2

An electrophotographic photoreceptor is obtained in the same manner as Example 1 except that the gallium nitride used in Example 1 is replaced with gallium nitride having a volume average grain diameter of 2.5 μm and the film thickness of the intermediate layer is 2.5 μm.

Example 3

An electrophotographic photoreceptor is obtained in the same manner as Example 1 except that the gallium-nitride-dispersed intermediate layer used in Example 1 is replaced with the intermediate layer having a volume average grain diameter of 1.5 μm formed by plasma spraying.

Example 4

An electrophotographic photoreceptor is obtained in the same manner as Example 3 except that the film thickness of the intermediate layer is 2.5 μm.

Comparative Example 1

An electrophotographic photoreceptor is manufactured that includes the conductive support body, the charge generation layer, and the charge transfer layer without the intermediate layer shown in Example 1.

Comparative Example 2

An electrophotographic photoreceptor is obtained in the same manner as Example 1 except that the coating liquid for the intermediate layer used in Example 1 is replaced with the following liquid and the thickness of the intermediate layer is 3.5 μm.

(Coating Liquid for Undercoating Layer)

6 parts by weight of an alkyd resin (BEKKOZOL 1307-60-EL manufactured by DAINIPPON INK AND CHEMICALS, INCORPORATED)

4 parts by weight of a melamine resin (SUPER BEKKAMIN G-821-60 manufactured by DAINIPPON INK AND CHEMICALS, INCORPORATED)

40 parts by weight of titanium oxide 50 parts by weight of methylethyl ketone

The following tests are conducted with respect to the electrophotographic photoreceptors of Examples 1 through 4 and Comparative Examples 1 and 2.

(Measurement of Charged Potential and Dark Attenuation Rate)

As described in the embodiments of the present invention, the amount of charge potential and the charge retention of the photoreceptor largely vary depending on the characteristics of the intermediate layer. Accordingly, the charge potential and the dark attenuation rate of the photoreceptor at the charge are measured by the following conditions as the characteristics evaluation for the intermediate layer. Furthermore, as shown in the following formula, the dark attenuation rate is calculated from the photoreceptor charge potential $V_1$ after the charge time has elapsed ($t_1$=20 seconds) and the photoreceptor charge potential $V_2$ after the charge retention time ($t_2$=20 seconds) has elapsed. The measurement results are shown in Table 1. Also, the measurement device and the measurement conditions are shown as follows.

Measurement device: EPA-8200 (manufactured by Kawaguchi Electric Works)

Measurement Conditions:

Sample size: 50 mm×50 mm

Discharge method: corona discharge

Discharge current: 20 μA

Sample rotational speed: 1000 rpm

Charge time ($t_1$): 20 seconds

Charge retention time ($t_2$): 20 seconds

Dark attenuation rate: $1-V_2/V_1$ (Sheet Running by Real Machine)

For a sheet running test by a real machine, the photoreceptor described above is loaded in a process cartridge for electrophotography, and then the process cartridge is loaded in the modified machine of Imagio MF2200 manufactured by Ricoh Company Limited. The image forming apparatus here uses a laser diode at 655 nm as an image exposure light source and a corona charge method (scorotron type) as a charge method. As a test method, printing is serially performed for 30,000 sheets after the setting of the dark part potential to −800 V so that the image and dark part potential are measured at an initial printing stage and at a 30,000$^{th}$ printing stage. The results obtained by evaluating the photoreceptors manufactured in Examples 1 through 4 and Comparative Example 2 according to the present test method are shown in Table 2.

TABLE 1

| EXAMPLES COMPARATIVE EXAMPLES | CHARGE POTENTIAL (−V) | DARK ATTENUATION RATE (—) |
|---|---|---|
| EXAMPLE 1 | 1025 | 0.07 |
| EXAMPLE 2 | 1038 | 0.03 |
| EXAMPLE 3 | 925 | 0.11 |
| EXAMPLE 4 | 962 | 0.09 |
| COMPARATIVE EXAMPLE 1 | 221 | 0.67 |
| COMPARATIVE EXAMPLE 2 | 993 | 0.10 |

As is apparent from Table 1, the numeric values of the charge potential and the dark attenuation rate in Examples 1 through 4 show no problem in actual use of the photoreceptors. In contrast, Comparative Example 1 shows that the charge potential is very small and the dark attenuation rate is large, representing a difficulty in using the photoreceptor. Furthermore, Comparative Example 2 shows that the numeric values of the charge potential and the dark attenuation rate are equivalent to those of Examples 1 through 4, representing sufficient characteristics of the intermediate layer at the initial printing stage.

TABLE 2

| EXAMPLES | INITIAL PRINTING STAGE | | 30,000th PRINTING STAGE | |
|---|---|---|---|---|
| COMPARATIVE EXAMPLES | DARK PART POTENTIAL (−V) | OUTPUT IMAGE | DARK PART POTENTIAL (−V) | OUTPUT IMAGE |
| EXAMPLE 1 | 795 | NO IMAGE DEFECTS OCCUR | 790 | NO IMAGE DEFECTS OCCUR |
| EXAMPLE 2 | 800 | NO IMAGE DEFECTS OCCUR | 790 | NO IMAGE DEFECTS OCCUR |
| EXAMPLE 3 | 790 | NO IMAGE DEFECTS OCCUR | 790 | NO IMAGE DEFECTS OCCUR |
| EXAMPLE 4 | 805 | NO IMAGE DEFECTS OCCUR | 800 | NO IMAGE DEFECTS OCCUR |
| COMPARATIVE EXAMPLE 2 | 800 | NO IMAGE DEFECTS OCCUR | 775 | BACKGROUND STAINS OCCUR |

As apparent from Table 2, no large variations are found in the dark part potential and the output image in the electrophotographic photoreceptors (of Examples 1 through 4) as described in the present invention at the initial printing stage as well as at the $30{,}000^{th}$ printing stage. The electrophotographic photoreceptor of Comparative Example 2 has no problem both in the dark part potential and the output image at the initial printing stage. However, it is confirmed that the dark part potential is lowered and slight background stains occur in the output image at the $30{,}000^{th}$ printing stage. This may be caused by a degradation in hole blocking characteristics in the intermediate layer.

These results show that the electrophotographic photoreceptors according to the embodiments of the present invention may sufficiently suppress the generation of charges from the conductive support body to the photosensitive layer and are excellent in that there occur no characteristic variations of the intermediate layer during its use.

The embodiments disclosed herein are provided for exemplification purpose and are not intended to limit the present invention. The scope of the present invention is shown by the claims not by the embodiments described above, and variations and modifications may be made without departing from the scope of the present invention.

The present invention is applied to a process cartridge having a photoreceptor capable of sufficiently suppressing the injection of charges (holes) from the conductive support body to the photosensitive layer. In addition, the present invention is applied to an image forming apparatus having the photoreceptor capable of sufficiently suppressing the injection of charges (holes) from the conductive support body to the photosensitive layer.

The present application is based on Japanese Priority Patent Application No. 2007-055878, filed on Mar. 6, 2007, the entire contents of which are hereby incorporated by reference.

What is claimed is:

1. An electrophotographic photoreceptor having at least a photosensitive layer and an intermediate layer on a conductive support body, wherein the intermediate layer is formed between and in contact with the conductive support body and the photosensitive layer and is made of a gallium nitride crystal having electron affinity greater than that of the photosensitive layer.

2. The electrophotographic photoreceptor according to claim 1, wherein the intermediate layer is made of at least a crystal grain composed of the gallium nitride crystal and a binder properly selected from organic materials.

3. The electrophotographic photoreceptor according to claim 2, wherein a grain diameter of the crystal grain contained in the intermediate layer and composed of the gallium nitride crystal is 1 μm or larger.

4. The electrophotographic photoreceptor according to claim 2, wherein the crystal grain contained in the intermediate layer and composed of the gallium nitride crystal is free from dislocation.

5. The electrophotographic photoreceptor according to claim 1, wherein the gallium nitride crystal contained in the intermediate layer is formed by a flux method.

6. An image forming method comprising:

a charging step of charging at least an electrophotographic photoreceptor, the electrophotographic photoreceptor having at least a photosensitive layer and an intermediate layer on a conductive support body, with the intermediate layer being formed between and in contact with the conductive support body and the photosensitive layer and being made of a gallium nitride crystal having electron affinity greater than that of the photosensitive layer; and a latent image forming step of forming an electrostatic latent image on a surface of the electrophotographic photoreceptor charged in the charging step.

7. The image forming method of claim 6, further comprising a development step of attaching toner to the electrostatic latent image formed in the latent image forming step.

8. The image forming method of claim 7, further comprising a transfer step of transferring the toner image formed in the development step onto a transfer body.

9. The image forming method of claim 8, further comprising a cleaning step of removing the toner left on the surface of the electrophotographic photoreceptor after the transfer.

10. An image forming apparatus comprising:

a charging unit configured to charge an electrophotographic photoreceptor, the electrophotographic photoreceptor having at least a photosensitive layer and an intermediate layer on a conductive support body, with the intermediate layer being formed between and in contact with the conductive support body and the photosensitive layer and being made of a gallium nitride crystal having electron affinity greater than that of the photosensitive layer; and a latent image forming unit configured to form an electrostatic latent image on a surface of the electrophotographic photoreceptor charged by the charging unit.

11. The image forming apparatus of claim 10, further comprising a development unit configured to attach toner to the electrostatic latent image formed by the latent image forming unit.

12. The image forming apparatus of claim 11, further comprising a transfer unit configured to transfer the toner image formed by the development unit onto a transfer body.

13. The image forming apparatus of claim 12, further comprising a cleaning unit configured to remove the toner left on the surface of the electrophotographic photoreceptor after the transfer.

14. A process cartridge for an image forming apparatus, comprising:

a charging unit configured to charge an electrophotographic photoreceptor, the electrophotographic photoreceptor having at least a photosensitive layer and an intermediate layer on a conductive support body, with the intermediate layer being formed between and in contact with the conductive support body and the photosensitive layer and being made of a gallium nitride crystal having electron affinity greater than that of the photosensitive layer; and a latent image forming unit configured to form an electrostatic latent image on a surface of the electrophotographic photoreceptor charged by the charging unit, wherein the process cartridge is capable of being detached from an image forming apparatus main body.

15. The process cartridge of claim 14, further comprising a development unit configured to attach toner to the electrostatic latent image formed by the latent image forming unit.

16. The process cartridge of claim 15, further comprising a transfer unit configured to transfer the toner image formed by the development unit onto a transfer body.

17. The process cartridge of claim 16, further comprising a cleaning unit configured to remove the toner left on the surface of the electrophotographic photoreceptor after the transfer.

* * * * *